US010603643B2

(12) United States Patent
Baig et al.

(10) Patent No.: US 10,603,643 B2
(45) Date of Patent: Mar. 31, 2020

(54) PROCESS AND DEVICE FOR DISPERSING GAS IN A LIQUID

(71) Applicant: SUEZ INTERNATIONAL, Paris la Defense (FR)

(72) Inventors: Sylvie Baig, Montesson (FR); Pedro Fonseca, Rueil-Malmaison (FR); Francois Le Quesne, Issy les Moulineaux (FR)

(73) Assignee: SUEZ INTERNATIONAL, Paris la Defense (FR)

( * ) Notice: Subject to any disclaimer, the term of this patent is extended or adjusted under 35 U.S.C. 154(b) by 160 days.

(21) Appl. No.: 15/121,491

(22) PCT Filed: Mar. 9, 2015

(86) PCT No.: PCT/IB2015/051705

§ 371 (c)(1),
(2) Date: Aug. 25, 2016

(87) PCT Pub. No.: WO2015/132773

PCT Pub. Date: Sep. 11, 2015

(65) Prior Publication Data

US 2016/0361692 A1 Dec. 15, 2016

(30) Foreign Application Priority Data

Mar. 7, 2014 (FR) ..... 14 51870

(51) Int. Cl.
*B01F 3/04* (2006.01)
*B01F 5/04* (2006.01)
*B01F 5/06* (2006.01)

(52) U.S. Cl.
CPC ..... *B01F 3/0446* (2013.01); *B01F 3/04106* (2013.01); *B01F 3/04439* (2013.01);
(Continued)

(58) Field of Classification Search
CPC .. B01F 3/0446; B01F 5/0475; B01F 5/04751; B01F 5/0478; B01F 5/0483;
(Continued)

(56) References Cited

U.S. PATENT DOCUMENTS 805,653 A * 11/1905 Lowe ..... B01F 5/0428 261/111
2,767,127 A * 10/1956 Guala ..... B01J 8/0025 196/132

(Continued)

FOREIGN PATENT DOCUMENTS

DE 102 50 707 A1 5/2004
DE 20 2006 002983 U1 4/2006

(Continued)

OTHER PUBLICATIONS

Google Patents, English Translation of DE 20 2006 002983 U1, Apr. 27, 2006. pp. 1-2. Retrieved Feb. 6, 2018. <https://patents.google.com/patent/DE202006002983U1/en?oq=DE202006002983>. (Year: 2006).*

(Continued)

*Primary Examiner* — Charles Cooley
(74) *Attorney, Agent, or Firm* — Young & Thompson

(57) ABSTRACT

Process and device for dispersing gas in a downward flow of liquid, according to which the liquid is distributed along at least one jet (A) directed downwards, preferably along a plurality of jets; gas is distributed radially (F) towards the liquid jet or jets in order to be entrained by the liquid; and the liquid-gas mixture is channeled into a downflow vertical tube (P).

6 Claims, 1 Drawing Sheet

(52) U.S. Cl.
CPC ..... *B01F 3/04503* (2013.01); *B01F 3/04751* (2013.01); *B01F 5/048* (2013.01); *B01F 5/0651* (2013.01); *B01F 2003/04872* (2013.01); *B01F 2003/04879* (2013.01); *B01F 2003/04886* (2013.01); *B01F 2003/04893* (2013.01)

(58) Field of Classification Search
CPC .. B01F 5/0485; B01F 5/0486; B01F 3/04439; B01F 3/04106; B01F 5/048; B01F 3/04751; B01F 3/04503; B01F 5/0651; B01F 2003/04872; B01F 2003/04893; B01F 2003/04879; B01F 2003/04886
USPC ..... 366/101; 261/76, 78.2, 94–97, 100, 261/105–107, 122.1
See application file for complete search history.

(56) References Cited

U.S. PATENT DOCUMENTS 3,440,018 A * 4/1969 Eckert ..... B01D 53/18 261/106
4,168,913 A * 9/1979 Kono ..... B01F 13/0205 366/101
4,498,819 A * 2/1985 El-Saie ..... B01F 5/0057 137/896
4,507,253 A 3/1985 Wiesmann
4,572,821 A 2/1986 Brodard et al.
5,462,351 A * 10/1995 Royal ..... B65D 88/72 222/195
5,935,490 A * 8/1999 Archbold ..... B01F 3/0446 261/76
6,001,247 A 12/1999 Schulz
6,007,055 A * 12/1999 Schifftner ..... B01D 53/18 261/106
2013/0264292 A1 10/2013 Wieland et al.
2016/0361692 A1* 12/2016 Baig ..... B01F 5/048
2019/0162636 A1* 5/2019 Molter ..... G01N 1/2252

FOREIGN PATENT DOCUMENTS

EP 0 086 019 A1 8/1983
FR 2 545 732 A1 11/1984
FR 2 762 232 A1 10/1998
FR 2 776 942 A1 10/1999
WO 92/03220 A1 3/1992
WO 2012/025214 A1 3/2012
WO 2013/082132 A1 6/2013

OTHER PUBLICATIONS

International Search Report, dated Jun. 16, 2015, from corresponding PCT application.

* cited by examiner

PROCESS AND DEVICE FOR DISPERSING GAS IN A LIQUID

BACKGROUND OF THE INVENTION

1. Field of the Invention

The invention relates to a process and to a device for dispersing gas in a downflow of liquid.

The invention relates more particularly to a hybrid mixer and jet injector gas-liquid jet dispersion process and device. The objective of the process is to homogeneously disperse the gas in the form of fine bubbles in a driving liquid for gas-liquid contacting or with a view to subsequent contacting with the bulk liquid in a surrounding contactor in which the device is implanted. The device is composed of an injection head comprising a liquid-jet mixing chamber in the upper part and a vertical coaxial tube with two-phase jet in the lower part, forming a nozzle. Said homogeneous gas-liquid dispersion is produced for a gas holdup of between 5% and 70%, preferably between 30% and 50%.

The invention relates more particularly to a process and a device for injecting ozone or a mixture of ozone and oxygen and/or air into a flow of water, in order to purify it.

The performance of the gas dispersion may be expressed, on the one hand, as a function of the size of the gas bubbles produced and, on the other hand, as a function of a gas/liquid volume ratio of the two-phase gas-liquid mixture resulting from the dispersion, which ratio is linked to the gas holdup defined as the ratio of the volume of the gas phase relative to the total volume of the contactor, which is equal to the sum of the volumes of gas and liquid that it contains, or as the ratio of the volume flow rate of the gas phase relative to the sum of the gas and liquid volume flow rates. The injection processes and devices of the prior art make it possible to obtain a homogeneous dispersion of gas in the form of bubbles with an acceptable energy consumption for a relatively low gas/liquid volume ratio, that does not exceed 0.5 in general.

Two-phase gas-liquid contactors are suited to numerous industrial applications, such as liquid-phase oxidations and hydrogenations or absorptions of a gas by a liquid with or without a chemical reaction. The devices for bringing gas and liquid phases into contact are designed to meet, as effectively as possible, the requirement of ensuring the transfer of the required amounts of mass, at the best cost, also including concepts linked to the operation such as flexibility with respect to the amounts of mass involved, operating safety and stability, speed of executing the steps of starting up and setting a regime, potential operating time (corrosion, maintenance, . . . ).

In any case, the amount of mass exchanged within two-phase equipment, denoted by N, can be evaluated by:

$$N = \text{mass transfer coefficient} \times \text{interfacial exchange area} \times \text{exchange potential}$$

Thus, gas-liquid contactors are designed to offer the largest exchange area compatible with hydrodynamic conditions relating to the circulating flow rates of the fluids and physicochemical properties of the latter. It is furthermore essential that the pressure drop on the gas side is as moderate as possible in order to avoid unacceptable energy expenditures or pressure conditions that are incompatible with the application conditions.

The contactors in which the gas is dispersed in the form of bubbles in a liquid cover the following technologies: bubble column, mechanically stirred tank, perforated plate column, co-current tubular contactor such as static mixer, submerged-jet ejector and driving-liquid Venturi ejector (M. Roustan, Transferts gaz-liquide dans les procédés de traitement des eaux et des effluents gazeux [Gas-liquid transfers in water and gaseous effluent treatment processes], Editions Lavoisier 2003; Pierre Trambouze, Réacteurs chimiques—Technologie [Chemical reactors—Technology], J4020, Editions Techniques de l'Ingénieur, 1993). These various contactors are characterized by variable degrees of liquid holdup and interfacial area. Among these, tubular contactors operating with co-current flow of gas and liquid offer the advantages both of allowing a broader operating range in terms of holdup of gaseous dispersed phase (defined as the ratio of the volume of the gas phase relative to the total volume of the contactor, which is equal to the sum of the volumes of gas and liquid that it contains, or as the ratio of the volume flow rate of the gas phase relative to the sum of the gas and liquid volume flow rates) and of generating a very large interfacial area. The main drawback lies in the pressure drop brought about in order to produce the dispersion of the gas, which then limits either the holdup of the dispersed gas phase to 30% at best in the case of static mixer, submerged-jet ejector and driving-liquid Venturi ejector systems, or the immersion height to less than a few meters at most for submerged-jet ejectors operating with gas holdups of greater than 50% since a facility for injecting gas at greater depth may have the major drawback of requiring a pressurized gas source, for example a compressor and its associated pipework.

2. Description of the Related Art

WO 2012/025214 presents a device and a process for absorption of ozone in a tubular contactor for the treatment of liquids, according to which the injection of ozone-containing gas takes place in the stream of liquid circulating by means of at least two static mixers spaced apart by contact zones.

WO 2013/082132 relates to a process and to an apparatus for injecting a gas into a liquid, in which a rotating helical impeller located within a draft tube submerged in the liquid creates a downward flow of liquid within the draft tube supplied by gas through nozzles located either above or below or along the helical impeller. The liquid is drawn into the draft tube at a superficial velocity greater than a terminal ascent velocity of the gas bubbles, so as to allow entrainment of undissolved gas bubbles in the bulk liquid into the liquid that is drawn into the draft tube. A transfer efficiency of 90% is obtained in the contactor for a gas holdup of 5% in the tube of less than one meter long.

EP 0 086 019 relates to a two-stage hybrid contactor combining a spray tower and a bubble column for dissolving a gas in a liquid, preferably for the ozonation of water according to which the gas is injected by means of a submerged tube. According to this process, a fraction of the liquid stream is used to inject the gas in the form of bubbles with the aid of a submerged tube that introduces the two-phase mixture into a downward vertical stream of the main flow of liquid supplied by runoff in the upper outer annular part of the contactor. This device thus involves a free runoff space of significant volume that promotes degassing so that the gas dissolution efficiency is decreased. The gas holdup in the injection tube is indicated as equal to 13% at most.

FR 2 762 232 also describes a process and a device for contacting ozone in liquids, especially water, according to which a two-phase mixture of the partial flow of liquid to be treated and of a pressurized ozone-laden gas is produced in a vertical tube with downward co-current flow of gas and liquid optionally containing bubble-shearing devices, the whole assembly constituting a portion of a contactor for absorption of ozone in the liquid in the form of a U-tube as described in FR 2 545 732. The dispersion of the gas in the form of bubbles is obtained in the downward tube under the effect of the liquid velocity of around 1.5 m/s. The height of the contactor is between 20 and 35 m. This type of contactor involves operating with a gas holdup of less than 20% in order to control the two-phase water and gas mixture (Degrémont, Mémento Technique de l'eau [Water Treatment Handbook], Editions Lavoisier, 2005).

U.S. Pat. No. 6,001,247 also discloses a contactor composed of a diffusion compartment equipped with a submerged vertical tube with downward co-current flow of ozone-containing gas and water in order to uniformly introduce the gas. The inside of the tube contains coaxial porous elements in order to distribute the ozone-containing gas in the form of bubbles into the water that circulates therein.

FR 2 776 942 also gives details of a device for dispersing a gas in a liquid by a submerged jet. The dispersion device consists of a single nozzle emitting a downward-directed vertical liquid jet, of a tube coaxial with the jet, and of an impact plate located close to the lower end of the tube. The dispersion level is maintained as close as possible to the outlet of the nozzle by means of maintaining the level in the surrounding contactor. The jet produced by the nozzle sucks up the gas admitted laterally to the nozzle and carries it into the tube simultaneously with the dispersion that penetrates from the outside toward the inside of the tube by means of submerged holes. Everything is dispersed in the bulk of the surrounding contactor by impact on the plate. No bubble reaches the volume located below the plate, from which the liquid that supplies the nozzle is drawn off by means of a pump. As is readily understood, this device with a single emitting nozzle is suitable for the dispersion of the gas in a contactor of reduced volume, typically less than one cubic meter as shown. This device is furthermore difficult to construct on a large scale due to the weakness imparted to the structure by the recirculation orifices to be made in the down tube. Finally, the given upper limit of ejection velocity of 12 m/s is unacceptable with respect to the abrasion of the materials for the construction of the down tube.

SUMMARY OF THE INVENTION

One objective of the process according to the invention is, above all, to avoid the numerous drawbacks of tubular contactors operating with co-current flow of gas and liquid that are capable of producing a large interfacial area and that are described in the prior art. The main drawbacks are recalled below:

- the large pressure drop brought about in order to produce the dispersion of the gas,
- the limitation of the operation of these contactors to holdups of the dispersed gas phase of 30% or to gas/liquid volume ratios of 0.5 at best in the case of static mixer, submerged-jet ejector and driving-liquid Venturi ejector systems in industrial-scale applications,
- the limitation of the immersion height to less than a few meters at most for submerged-jet ejectors operating with gas holdups of greater than 50% corresponding to gas/liquid volume ratios of greater than 1 whereas static pressure is beneficial for gas-liquid mass transfer,
- the limitation of the design of the submerged jets to reduced contactor volumes and heights under the effect of probable engineering difficulties for the extrapolation of larger-scale systems,
- the use of structural elements such as static mixer elements, helical elements, liquid ejection nozzles that are sensitive to clogging by deposits and that require increased maintenance,
- operating conditions with a liquid velocity of greater than 10 m/s that are unacceptable with respect to the service life of the equipment,
- the poor flexibility of the systems with respect to the variation of the operating conditions.

Another objective of the invention is to make it possible to obtain a two-phase mixture with a gas/liquid volume ratio of greater than 0.3, without however consuming too much energy and without involving high liquid pressures, of the order of 4 bar. It is also desirable that the dispersion process and device are simple to use and that the maintenance thereof is not rendered difficult by the presence of particles in the liquid.

According to the invention, the process for dispersing gas in a downward flow of liquid is characterized in that:

- the liquid is distributed as at least one downward-directed jet, preferably as a plurality of jets,
- the gas is distributed radially toward the liquid jet(s) in order to be entrained by the liquid,
- and the liquid-gas mixture is channeled in a vertical tube with downward flow.

Advantageously, the gas is distributed under a pressure of less than 2 bar, preferably less than 1.5 bar.

The velocity of the liquid jets may be between 4 and 10 m/s, preferably between 6 and 8 m/s.

The cross section of the vertical tube is at least equal to the total emission area of the liquid jets, and at most equal to 2 times this very area, said cross section preferably being between 1.2 and 1.5 times the total emission area of the jets.

Advantageously, the liquid is directed above a horizontal plate comprising a plurality of orifices within a zone, in order to flow downward as a plurality of liquid jets,

- the gas is distributed radially toward the interior of said zone of orifices for the liquid,
- the liquid-gas mixture is channeled along a decreasing section until it reaches the vertical tube with downward flow.

Preferably, the liquid-gas mixture is channeled in the vertical down tube for at least 0.2 second.

The gas injected may be selected from air, oxygen, ozone and carbon dioxide, these gases being injected alone or as mixtures.

Preferably, the liquid is aqueous including natural fresh waters or salt waters, wastewaters and more generally aqueous effluents, process waters in industry including in the sector for production of drinking water.

The invention also relates to a device for dispersing gas in a liquid, in particular for the implementation of a process as defined previously, comprising an inlet pipe for the liquid to be treated, characterized in that it comprises:

- in the upper part, an injection head connected to the inlet pipe and comprising a liquid-jet mixing chamber,
- and in the lower part, a vertical, preferably coaxial, tube with two-phase flow.

The injection head comprises a compartment with, in the lower part, a horizontal distribution plate for the liquid perforated with at least one orifice, and an annular chamber provided under the plate at its periphery, and comprising at least one opening for distribution of the gas along a centripetal radial direction, the mixing chamber, located under the plate, being in the form of a convergent section for coupling to the vertical down tube.

Advantageously, the diameter of the orifices of the plate is sufficient, in particular at least equal to 10 mm, to prevent clogging due to particles contained in the liquid, in particular in wastewaters.

The device may comprise a radial inlet of the gas into the distributing annular chamber, from a gas pipe that extends beyond the radial inlet for possible venting to the atmosphere.

Such venting to the atmosphere is particularly advantageous, especially since it improves the safety during the operation of such a device, in particular during a shutdown sequence of the device. Such a shutdown sequence typically begins by evacuating the gas contained in the device, replacing it with outside air, by means of the extension, or vent pipe, of said gas pipe. Typically, a vent valve 7 is gradually opened so as to introduce outside air into the mixing chamber through this vent pipe, then a gas inlet valve 8 is closed so as to interrupt the arrival of gas in the mixing chamber through said gas pipe. The venting to the atmosphere thus makes it possible to avoid any implosion phenomenon of the device. This is in particular very advantageous in the case where the gas introduced into the mixing chamber through the gas pipe is dangerous, typically ozone.

Moreover, such venting to the atmosphere makes it possible to comply with such safety constraints in particular when the device injects gas into a water level located at a relatively low altitude relative to the altitude of the injection head, that is to say when said vertical down tube has a relatively large length before its submersion, for example 10 meters.

The venting to the atmosphere also makes it possible to improve the flexibility of the device during a start-up sequence in the course of which a liquid is injected into the mixing chamber through said inlet pipe of the liquid to be treated. Typically, during such a start-up sequence, the vent valve 7 is opened, enabling at least one portion of the gas present in the mixing chamber to be evacuated. The venting to the atmosphere also enables the gas inlet valve 8 to be closed until the desired hydraulic regime is obtained. Then the gas inlet valve 8 is opened and the vent valve 7 is closed.

The cross section of the vertical tube is at least equal to the total area of the orifices of the plate, and at most equal to 2 times this very area, and is preferably between 1.2 and 1.5 times the total area of the orifices of the plate.

The length of the down tube may be between 1 and 30 meters, and is preferably between 1 and 15 meters.

The convergent section of the mixing chamber may be frustoconical, the angle of inclination of the generatrices of the frustum relative to the axis being between 15° and 45°.

The injection system that is the subject of the invention is a hybrid mixer and jet injector gas-liquid jet dispersion system. Said system is composed of an injection head comprising a liquid-jet mixing chamber in the upper part and a vertical coaxial tube with two-phase jet in the lower part, forming a nozzle. It has the role of homogeneously dispersing the gas in the form of fine bubbles in the driving liquid as gas-liquid contactor or with a view to subsequent contact with the bulk liquid in a surrounding contactor. Said gas-liquid dispersion is produced for a gas holdup of between 5% and 70%, preferably between 30% and 50%.

The injection head is designed so as to carry out a pre-mixing of the liquid and gas upstream of the nozzle, the mixture being rendered homogeneous along the descent to the nozzle.

The gas and the liquid may be those involved in any operation requiring the formation of a gas-liquid dispersion.

Preferably, the gas injected will be selected from air, oxygen, ozone and carbon dioxide, these gases being injected alone or as mixtures.

Preferably, the liquid will be aqueous including natural fresh waters or salt waters, wastewaters and more generally aqueous effluents, process waters in industry including in the sector for production of drinking water.

According to one preferred embodiment, the injection head is supplied by the liquid discharged by a pumping system and the gas resulting from the distribution system is at a pressure equal to or greater than the atmospheric pressure.

The injection head carries out a pre-mixing of the liquid and gas under the effect of one or more turbulent jets of liquid emitted into the radially-admitted gas stream. The liquid jets are produced by means of a device for distributing the liquid in the form of high-velocity jets, typically between 4 and 10 m/s, preferably between 6 and 8 m/s.

The distribution device is preferably a distribution plate with orifices. A mixing chamber located below the distribution device has, for the shape of the upper cross section, the shape of the cross-section of the distribution plate. The mixing chamber is of tulip or convergent frustoconical or cylindrical or parallelepipedal shape.

The turbulence of the jets is demonstrated by Reynolds numbers of greater than $10^5$. The emission of the liquid jets produces a velocity of interfacial friction in the gas which can thus reach more than 0.3 m/s, i.e. a velocity greater than the terminal velocity of gas bubbles of the order of 3 mm. A liquid flow diagram shows the liquid flow rate lines and demonstrates the zones of recirculation of liquid within the mixing chamber which is also filled with gas. The high-velocity liquid jets thus shear the gas and suck the gas pockets produced toward the down tube.

Furthermore, the liquid jets initiate the gas-liquid mass transfer. Considering an average contact time of the liquid jets of 0.15 s, the transfer coefficient is of the order of $1\times10^{-4}$ m/s depending on the nature of the gas. The exchange potential is equal to the equilibrium concentration between the gas and liquid. For example, in the case of carbon dioxide as gas to be dispersed in water and liquid distribution jets at the velocity of 10 m/s over a total area of 0.3 $m^2$ and of 1 m in height, the amount of carbon dioxide transferred amounts to 0.3 kg/s.

The mixing chamber is followed in the downstream portion by a coaxial, preferably cylindrical, tube. The cross section of the tube is at least equal to the total emission area of the liquid jets in the mixing chamber and at most equal to 2 times this very area. The ratio of these areas is preferably between 1.2 and 1.5.

It is known from the prior art that the flow in a vertical pipe may take several forms depending on the operating conditions and dimensions of the pipe. The transition between the various regimes takes place in the ratio of the gas and liquid flow rates:

- bubble flow appears for low values of the ratio of the gas and liquid flow rates. It is characterized by a highly turbulent continuous liquid phase with a homogeneous dispersion of gas bubbles of relatively uniform size,
- for higher ratios of the gas and liquid flow rates, intermittent bubble and slug and churn regimes occur,
- film and annular regimes appear for very high gas and liquid volume ratios.

The flow map in a vertical pipe depends, in order of importance: on superficial gas and liquid velocities, on the diameter of the pipe and on the properties of the fluids.

In the present case, the dispersion device according to the invention renders the two-phase mixture homogeneous during the downward co-current flow in the coaxial tube to the liquid distributor, as was observed for a gas holdup of 40%.

The length of the down tube may reach 30 meters in order to promote the mass transfer inside the tube and optionally in the surrounding contactor, the height of which corresponds to the working height of the dispersion system. The height is preferably between 1 and 25 m. A gas holdup in the two-phase volume equal to 50% corresponds to the compact stack of gas inclusions in the liquid. Hence, achieving a homogeneous bubble size in the down tube necessitates further shearing the volume of gas sucked up under the effect of the turbulence of the mixture when the frequency of coalescence of the bubbles is even greater because the gas retention therein is high. The turbulence of the mixture is demonstrated by Reynolds number levels of the two-phase mixture of greater than $10^4$. This turbulence is maintained by applying a relative liquid velocity equal to the liquid velocity of the distribution jets in the mixing chamber for the best continuity of flow, i.e. typically between 4 and 10 m/s. This velocity has a tendency to decrease slightly during the descent under the effect of the compression of the gas under the effect of the column of liquid and under the effect of the mass transfer that takes place. The regime is established in the bubble flow range from the upper portion of the tube. The quality of the mixing at the start of the down tube determines the pressure necessary for the injected gas.

Specifically, the pressure of the gas-liquid mixture is a function of the outlet pressure of the nozzle (mainly a function of the immersion height), of the pressure drops and of the weight of the column of liquid in the injection system (which may be considered to be the static component). It turns out that a flow regime of annular liquid film type such as that observed in the first meters of a tube equipped with a nozzle and without pre-mixing of the gas and liquid, operating at a gas holdup of 40%, prevents the downward transmission of static pressure.

The loss of liquid height translates directly into the need to increase the pressure of the gas at injection. The device according to the invention enables on the contrary a regular transmission of the pressure since it provides a good dispersion quality from the beginning of the descent in the tube. The size of bubbles produced is correlated to the energy dissipated which is itself dependent on the local holdup ratios and on the physicochemical properties of the fluids making up the dispersion. A dispersion of oxygen in water containing 40% gas is characterized by bubbles having a mean diameter equal to 2.5 mm at the end of the 10 m long tube.

The two-phase jet highly concentrated in dissolved gas produced at the tube outlet can then be dispersed in a surrounding contactor or discharged towards the outlet of the reactor according to the contact time necessary for the absorption and optionally for the reaction involved in the application. The surrounding contactor may be any contactor known from the prior art with ascending gas flow.

BRIEF DESCRIPTION OF THE DRAWINGS

The invention consists, apart from the arrangements set out above, of a certain number of other arrangements that will be mentioned more explicitly hereinbelow with respect to an exemplary embodiment described with reference to the appended drawing, but which is in no way limiting. In this drawing.

DETAILED DESCRIPTION OF THE PREFERRED EMBODIMENTS

Figure 1:
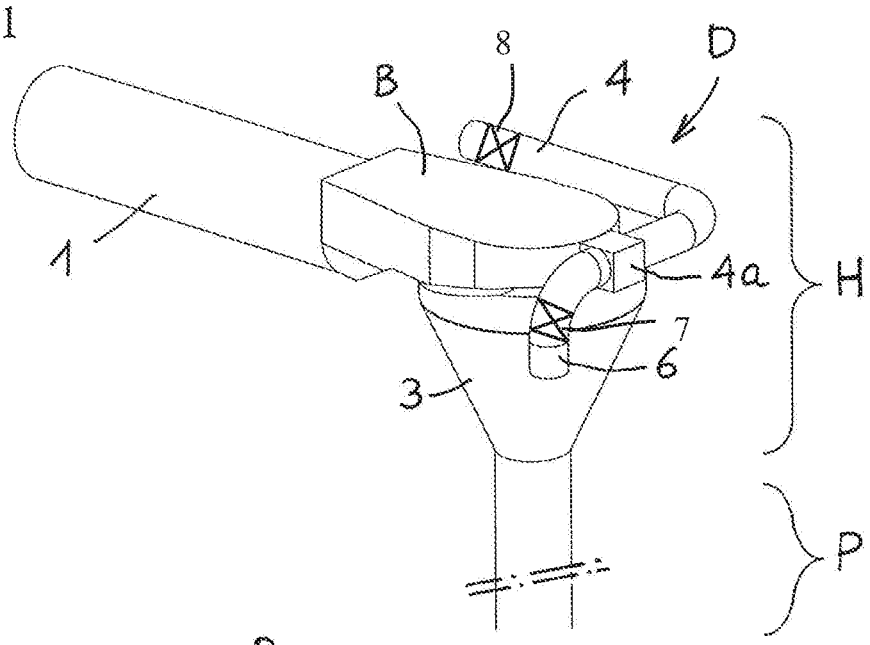
FIG. 1 is a schematic perspective top view of the dispersion device according to the invention.

With reference to the drawing, it can be seen that the dispersion device D comprises two assemblies: an injection head H and a jet dispersion tube P, forming a nozzle. The injection head H is the structure that connects the liquid and gas inlets, mixes these fluids and directs the resulting mixture into the down tube P.

Figure 2:
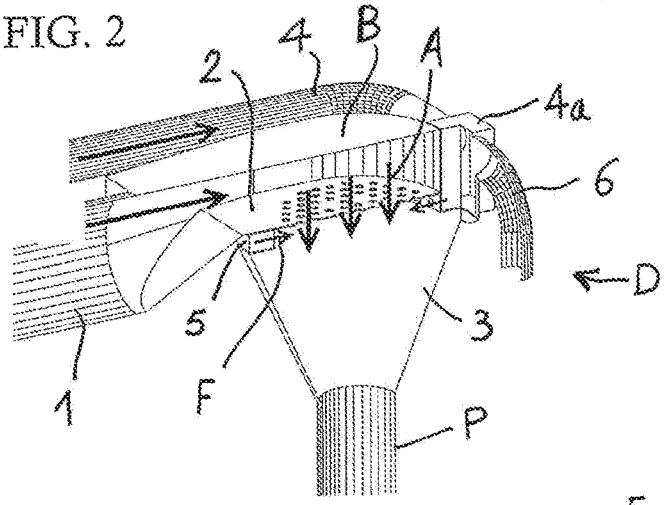
FIG. 2 is a schematic perspective view along another viewing angle and with cutaway portions of the device from FIG. 1.
Figure 3:
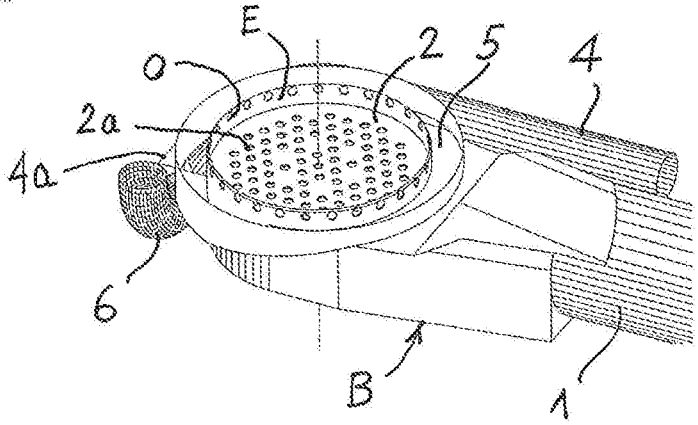
FIG. 3 is a perspective view of the underside of the device FIG. 1.

The injection head H is connected to the liquid inlet pipe 1 and comprises a compartment B with, in the lower part, a device for distributing the liquid, preferably a horizontal distribution plate 2 for the liquid, perforated with orifices 2*a*. The liquid flows vertically underneath the plate, following jets depicted by arrows A in FIG. 2.

An inlet line 4 for the gas to be injected is connected, via a radial box 4*a*, to an annular chamber 5 located under the plate 2, of which it surrounds the lower periphery. A wall E inwardly radially limiting the chamber 5 comprises nozzles or openings O for distribution of the gas following centripetal radial directions represented by arrows F in FIG. 2.

A mixing chamber 3 is located under the plate 2. The mixing chamber 3 is preferably of tulip or convergent frustoconical shape, but could be of cylindrical or parallelepipedal shape.

In the case where the chamber 3 is in the form of a downward frustoconical convergent section, the inclination of the generatrices of the convergent section relative to the geometric axis is preferably between 15° and 45°. The chamber 3 provides the coupling to the vertical down tube P, which is preferably coaxial and cylindrical.

An atmosphere-venting system 6 for the start-up phase is provided at the end of the pipe 4 beyond the coupling with the annular chamber 5. A vent valve 7 is provided in the system 6, and also a gas inlet valve 8.

The jet dispersion tube P is described hydraulically as a straight length of vertical pipe.

The operation of the device is the following.

The start-up sequence of the device, integrated in a surrounding contactor (not represented) makes it possible to better understand the general design of the device in its entirety.

- When the device or system is shut down, the water level inside the submerged tube P is equal to the water level outside. Above this level, the mixing chamber 3 and the tube P are filled with gas.
- The liquid supply is started according to a flow rate equal to a third of the desired operating flow rate. The liquid fills the supply line 1 of the system.
- The distribution plate 2 produces low-velocity liquid jets.
- The atmosphere-venting system 6 makes it possible to purge the gas initially contained in the injection head and the pockets of gas entrained at the start-up upstream in the top of the tube P.
- When the purge flow rate becomes zero, the vent valve 7 of the vent pipe of the atmosphere-venting system 6 gradually switches to gas supply via the pipe 4 and the system can begin production.

The liquid flow rate is brought to its operating value.

In steady state, the mixture of gas and water formed in the chamber 3 circulates toward the bottom of the tube.

The sequence for shutting down the dispersion device is structured as follows:

The first step consists in evacuating the gas contained in the device, by replacing it with outside air or an inert gas. For this, the vent valve 7 of the system 6 is gradually opened to the outside air or an inert gas, after which the gas inlet valve 8 of the system 6 is closed.

The device continues to operate, all of the gas present is replaced.

After a short period corresponding to the replacement with 5 times the total volume of the device, the device may be shut down under completely safe conditions, by gradually reducing the flow rate of water.

Although the foregoing descriptions that relate to the start-up and shutdown of the device mention several times the gradual variation of the operating conditions in terms of gas and liquid flow rate, it should be noted that the device is capable of reacting correctly to sudden changes in conditions, resulting for example from a power failure or any other event capable of resulting in an unscheduled shutdown.

This device makes it possible to provide a gaseous engagement that is eminently variable between 0.01 and 2 (if expressed as a ratio of the gas and liquid volume flow rates), at the best cost under the effect of the necessary pressure reduction, to produce a homogeneous dispersion of gas in the liquid suitable for providing the transfer of the required amounts of mass.

Simultaneously, it offers the following advantages:

the operating safety and stability;

the speed of executing the steps of starting up and setting a regime;

the potential operating time (corrosion, maintenance, . . . ).

This device resolves the drawbacks of the systems described in the prior art and is furthermore capable of replacing all or some of the gas injection and diffusion systems of bubble column type contactors, of the gas injection and agitation systems of agitated contactors. The contactors that result therefrom are much more efficient both from a technical and economic point of view.

The invention claimed is:

1. A device for injecting gas into a liquid comprising an inlet pipe (1) for the liquid to be treated, characterized in that the device comprises:

in an upper part, an injection head (H) connected to the inlet pipe and comprising a liquid-jet mixing chamber (3), and in a lower part, a vertical tube (P) with two-phase flow, the injection head (H) comprises a compartment (B) with, in the lower part, a horizontal distribution plate (2) for the liquid perforated with orifices (2*a*), and an annular chamber (5) provided under the plate (2) over its periphery, and comprising at least one opening for distribution of the gas along a centripetal radial direction (F), the mixing chamber (3), located under the plate, being in the form of a convergent section for coupling to the vertical tube (P), wherein said device further comprising a radial inlet (4*a*) of the gas into the annular chamber (5), from a gas pipe (4) that extends to and beyond the radial inlet (4*a*) as to form a venting system (6) configured to vent to the atmosphere or inert gas, the venting system (6) comprising a vent valve disposed in the gas pipe beyond the radial inlet and a gas inlet valve disposed in the gas pipe that extends to the radial inlet.

2. The device as claimed in claim 1, wherein the diameter of the orifices of the plate is sufficient to prevent clogging due to particles contained in the liquid.

3. The device as claimed in claim 1, wherein the cross section of the vertical tube is at least equal to the total area of the orifices (2*a*) of the plate, and at most equal to 2 times this total area.

4. The device as claimed in claim 1, wherein the length of the vertical tube (P) is between 1 and 25 meters.

5. The device as claimed in claim 1, wherein the convergent section of the mixing chamber (3) is frustoconical, the angle of inclination of the generatrices of the frustum of the frustoconical section relative to a vertical axis being between 15° and 45°.

6. The device of claim 1, wherein the vent valve is configured to introduce outside air or inert gas into the mixing chamber.

* * * * *